US006776296B2

(12) United States Patent
Herren

(10) Patent No.: US 6,776,296 B2
(45) Date of Patent: Aug. 17, 2004

(54) TOOTHBRUSH HOLDER

(76) Inventor: Anthony J Herren, 1527 Roscoe Davis Rd., Monroe, GA (US) 30656

( * ) Notice: Subject to any disclaimer, the term of this patent is extended or adjusted under 35 U.S.C. 154(b) by 15 days.

(21) Appl. No.: 10/293,714

(22) Filed: Nov. 12, 2002

(65) Prior Publication Data

US 2003/0089673 A1 May 15, 2003

Related U.S. Application Data

(60) Provisional application No. 60/337,906, filed on Nov. 13, 2001.

(51) Int. Cl.[7] ..... A47F 7/00

(52) U.S. Cl. ..... 211/66; 211/87.01; D6/528; D6/534

(58) Field of Search ..... 211/87.01, 89.07, 211/65, 66; D6/534, 528

(56) References Cited

U.S. PATENT DOCUMENTS

| | | | | |
|---|---|---|---|---|
| 1,180,056 | A | | 4/1916 | Lundy |
| 1,527,832 | A | * | 2/1925 | Bragg etl. |
| 1,544,694 | A | * | 7/1925 | Speidel |
| 1,615,571 | A | * | 1/1927 | Crecelius |
| 1,618,027 | A | | 2/1927 | Vogler |
| 2,177,504 | A | | 10/1939 | Thompson |
| 2,707,052 | A | * | 4/1955 | Brown |
| 2,797,886 | A | * | 7/1957 | Pinckney |
| 2,916,155 | A | | 12/1959 | Elliott |
| 3,748,094 | A | | 7/1973 | Scheidell |
| 3,748,414 | A | | 7/1973 | Pollo |
| 3,946,877 | A | | 3/1976 | Galicia |
| 4,492,309 | A | | 1/1985 | Fedoryshyn |
| 4,566,597 | A | * | 1/1986 | Caputo et al. ..... 211/87.01 |
| 4,781,608 | A | | 11/1988 | Hillmann |
| 4,854,457 | A | | 8/1989 | Perler |
| 5,259,519 | A | | 11/1993 | Lieberman |
| 5,505,301 | A | | 4/1996 | Foley |
| 5,573,019 | A | | 11/1996 | Hempel |
| D398,177 | S | * | 9/1998 | Garcia ..... D6/534 |
| D454,740 | S | * | 3/2002 | Baggott ..... D6/534 |
| 6,412,735 | B1 | * | 7/2002 | Mathieu ..... 211/66 X |
| 6,595,376 | B1 | * | 7/2003 | Lin ..... 211/70.6 |

* cited by examiner

*Primary Examiner*—Robert W. Gibson, Jr.
(74) *Attorney, Agent, or Firm*—Myers & Kaplan, LLC; Barry E. Kaplan, Esq.

(57) ABSTRACT

Provided is a toothbrush holder having a body with spoon-shaped cavities. The cavities optionally are lined with rubber material to conform to the shape of a toothbrush. Rubber grommets are utilized to hold the toothbrush in the cavity. A mounting plate attaches to a wall or other surface and the body removably attaches to the mounting plate. In an alternate embodiment, the grommets are replaced with rubber coated stainless steel rods. The cavity partially covers the toothbrush, allows easy access to light and air, can be easily used with one hand, and mounts closely to the wall.

21 Claims, 4 Drawing Sheets

TOOTHBRUSH HOLDER

RELATED APPLICATIONS

The inventor hereof claims priority pursuant to U.S. provisional patent application Ser. No. 60/337,906 filed on Nov. 13, 2001.

TECHNICAL FIELD

This invention relates generally to toothbrush holders; and, more particularly, to toothbrush holders which partially cover the toothbrush, are suitable for attachment to a wall, and/or may be operated with one hand.

BACKGROUND OF THE INVENTION

Toothbrushes by their very nature are bacteria laden and contain solid elements such as plaque and food particles that emanate from the mouth of the person using it. Illness or disease may be spread by toothbrushes that are splashed and/or come into contact with one another. It is desirable to have a toothbrush holder that sequesters the toothbrushes of various users and prevents one user's toothbrush from being splashed or coming into contact with the toothbrush of another user.

Although many types of toothbrush holders are available, most seem to lack in their ability to provide a toothbrush holder that is easy to use and promotes good hygiene. Positive attributes would include sheltering the toothbrush from being splashed, allowing air and light to be accessible so as to dry the toothbrush, inhibiting bacterial growth, and having a compact design such that placement near a wall is feasible.

U.S. Pat. No. 1,180,056 to Lundy teaches a toothbrush holder that is covered on all four sides and on top as well. The toothbrush is inserted from the bottom and is held therein via a dovetail-shaped rack. In this design, however, the cover makes it difficult to see the rack and further obstructs the passage of air and light to the toothbrush, thus creating a moist and/or humid atmosphere suitable for bacterial growth.

U.S. Pat. No. 2,177,504 to Thompson teaches a toothbrush holder which is held in place with a suction cup. The holder is made of pliable material and is configured so as to permit mounting thereof in a horizontal or vertical position. The toothbrush merely clips into one of two sets of jaws that hold the toothbrush in position. In this device the toothbrush is not covered at all, thus exposing the bristles of the toothbrush to bacterial contamination.

U.S. Pat. No. 3,138,414 to La Pollo teaches a sanitary rack for toothbrushes and other dentifrices. A plate is mounted to the wall by hooks facing outwardly. A loop on the holder engages the hooks to maintain the holder in position. A removable, U-shaped cleat attaches to the holder, wherein a toothbrush is simply snapped and secured therein. Each toothbrush is held within its own chamber. A cover rotates into position to cover each chamber. Air holes are provided in the cover adjacent each chamber. In this design the cover makes it difficult to see the holder and makes it difficult for the requisite amount of air and light to reach the toothbrush for sufficient aeration and drying thereof, thus promoting bacterial growth.

U.S. Pat. No. 3,946,877 to Galicia teaches a clip-type holder for toothbrushes, wherein the holder consists of a plastic strip that attaches to the wall and has a plurality of clips thereon, each of which consists of two fingers. The toothbrush is snapped into the fingers. In this device the toothbrush is not covered at all, exposing the bristles of the toothbrush to bacterial contamination.

U.S. Pat. No. 4,492,309 to Fedoryshyn teaches a multiple-object support rack. The rack consists of modified clothespins possessing slots to enable the clothespins to slide upon a rod, and to permit the opening and closing thereof. The rack is composed of one piece that mounts to a wall, and another piece that can be easily removed from the wall-mounted piece and/or engaged via snap-button mechanisms. In this device as well, the toothbrush is not covered at all, thus exposing it to bacterial contamination.

U.S. Pat. No. 4,854,457 to Perler teaches a hygienic toothbrush holder that holds the toothbrush in a clip. The clips are held in a faceplate that is removably mounted to an extended base by flexible prongs. The holder is mounted such that the bristles are held in a position so that they can drain over different areas without contamination of, or by, other brushes. In this device the toothbrush is not covered and is subject to bacterial contamination via water draining from the bristles of an upwardly mounted toothbrush.

U.S. Pat. No. 5,259,519 to Lieberman teaches an advertiser and hygienic toothbrush holder which has a C-shaped section that mounts to the wall, and a holder with a T-shaped section that engages the C-shaped section. The holder has holes for the toothbrushes to drop into and also includes a splashguard. In this device the toothbrush is also not covered.

It is readily apparent that an improved toothbrush holder is needed that sufficiently covers the toothbrush, yet permits the requisite amount of air and light to access the toothbrush for sufficient aeration and drying thereof, and wherein convenient mounting of the holder to a wall and one-handed operation thereof is also provided. It is, therefore, to the provision of such an improved toothbrush holder that the present invention is directed.

Accordingly, it is an object of the present invention to provide a new and improved toothbrush holder that may be removably attached to a wall.

Another object of the present invention is to provide a new and improved toothbrush holder that may be operated with one hand.

Still another object of the present invention is to provide a new and improved toothbrush holder that covers the toothbrush, yet still allows light and air to easily reach the toothbrush.

Yet still another object of the present invention is to provide a new and improved toothbrush holder that can be easily cleaned in a dishwasher.

Other objects, features, and advantages of the present invention will become apparent to those skilled in the art by reference to the drawings and to the detailed description of the preferred embodiment presented herein.

BRIEF SUMMARY OF THE INVENTION

In accordance with the several objects of this invention, in a preferred embodiment presented is an improved toothbrush holder that comprises a body with a multiplicity of spoon-shaped cavities integral therein, wherein the cavities are sized and shaped to receive a toothbrush. The cavities are formed so as to cover the toothbrush when it is placed in the holder. The cavities optionally are lined with soft rubber material that will conform to the shape of the toothbrush. On the front lower side of each cavity are a pair of rubber grommets which hold the toothbrush and allow it to be snapped in and out easily with one hand. The rubber grommets are removable so as to be easily cleaned. An optional toothpaste holder may be attached to the front of the body.

The body is thin so as to project a low profile, and is preferably rectangular with a curved top, but other shapes that are just as aesthetically pleasing and just as functional are possible.

A mounting plate is attached to a wall by screws, double-faced tape, or other means. The body is then removably attached to the mounting plate preferably by a plurality of expandable barbed pins that snap into holes in the mounting plate, or by other means well known in the art which could include hooks, hook-and-loop fasteners, or slidably engageable rails.

In an alternate embodiment, rubber grommets for holding is the toothbrush are replaced with stainless steel rods coated with rubber.

BRIEF DESCRIPTION OF THE DRAWINGS

The invention is better understood by reading the Detailed Description of the Preferred Embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED EMBODIMENT AND ALTERNATE EMBODIMENTS

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
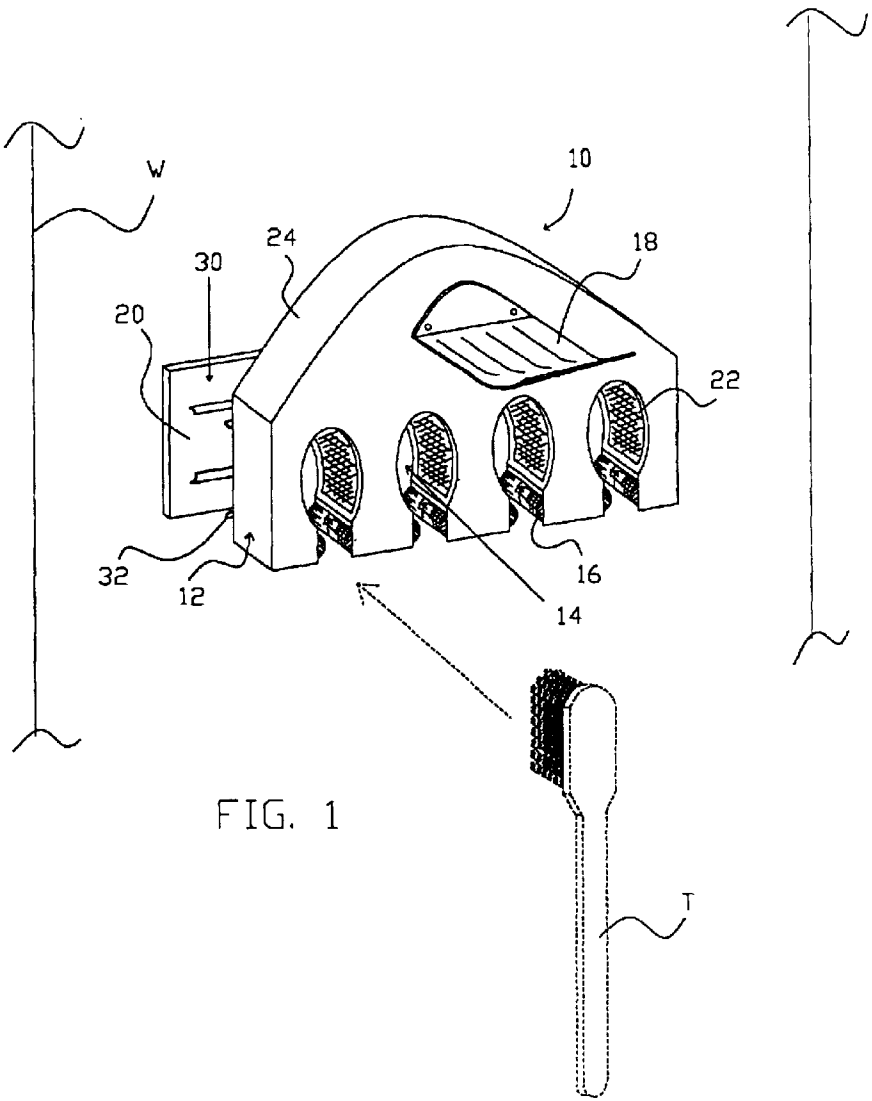
FIG. 1 is a perspective view of the toothbrush holder according to a preferred embodiment of the present invention, showing the body, cavities, and mounting plate.

Referring now to FIG. 1, toothbrush holder 10 comprises body 12 with a plurality of spoon-shaped cavities 14 formed integrally therein, and which are sized and shaped to receive toothbrushes T. Cavities 14 are formed so as to cover toothbrush T when it is placed in holder 10. Cavities 14 are optionally lined with soft rubber material 22 which will conform to the shape of toothbrush T. On the front lower side of each cavity 14 are a pair of rubber grommets 16 which hold toothbrush T and allow it to be snapped in and out easily with one hand. Rubber grommets 16 are removable so as to be easily cleaned. Cavities 14 may have an enclosed back, or alternatively, may be open. It will be recognized by one ordinarily skilled in the art that while cavities 14 may comprise a spoon-shape for conforming to the head of a conventional toothbrush, other cavity shapes are contemplated within the scope and functionality of the present invention.

Body 12 may be formed with integral upper portion 24, shown in FIG. 1 with an aesthetically pleasing and safe rounded upper edge. Optionally provided for the convenience of the user, and mounted upon body 12 or, preferably, upon upper portion 24, may be an optional toothpaste holder 18, which may take the form of a small shelf, an outwardly jutting wire rack, clamp, clasp, hanger, or the like.

Body 12, rubber grommets 16, and toothpaste holder 18 are preferably made of material that may be safely washed in a dishwasher.

Body 12 is thin so as to project a low profile, and is preferably rectangular, but other shapes that are aesthetically pleasing and functional are possible. The low profile allows body 12 to fit into tight areas around a sink with a minimum amount of obstruction. Body 12 may be decorated with graphic images and may be produced in a wide variety of colors.

Figure 2A:
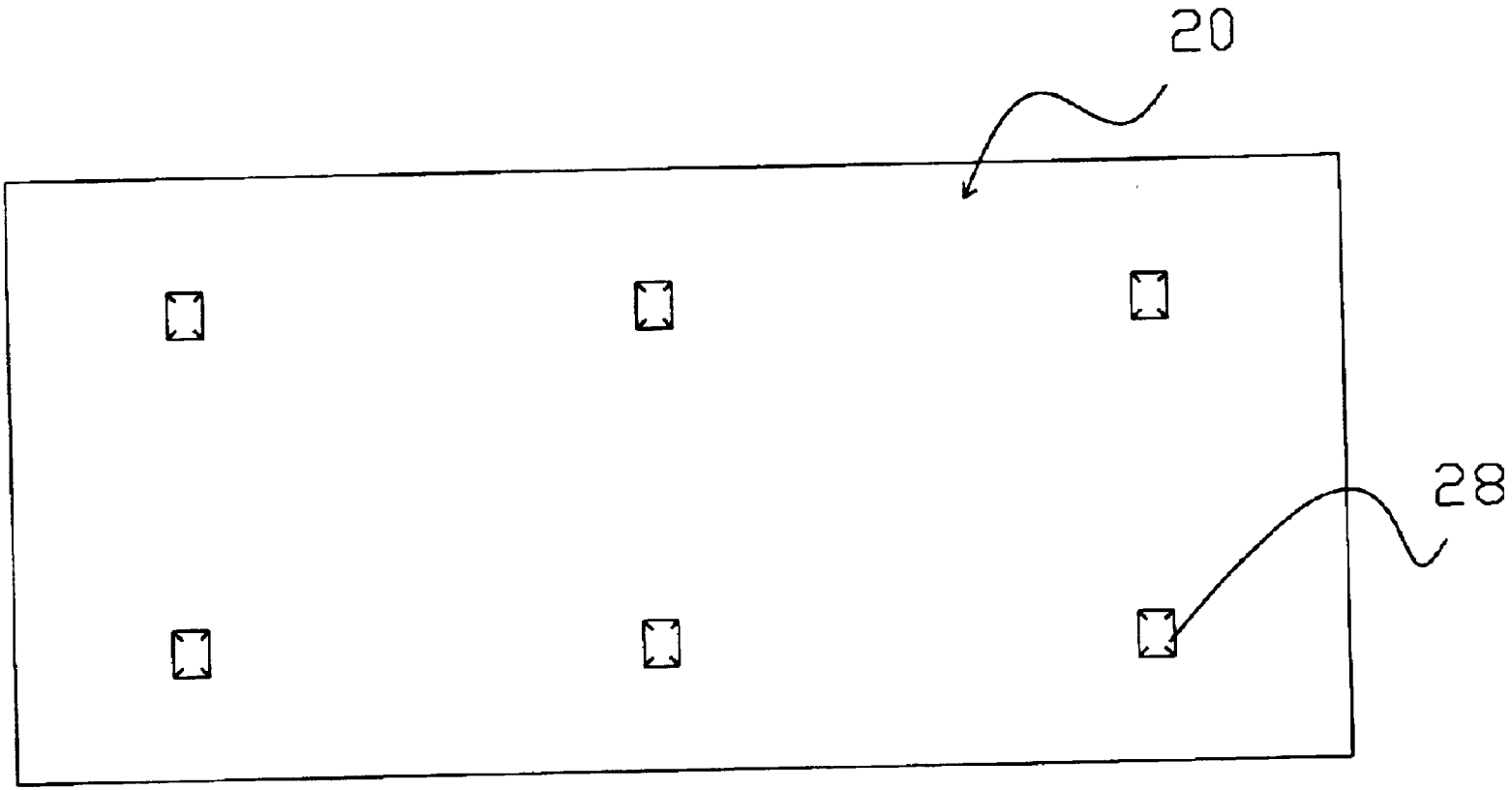
FIG. 2A is a front view of the mounting plate of the toothbrush holder according to a preferred embodiment of the present invention.
Figure 2B:
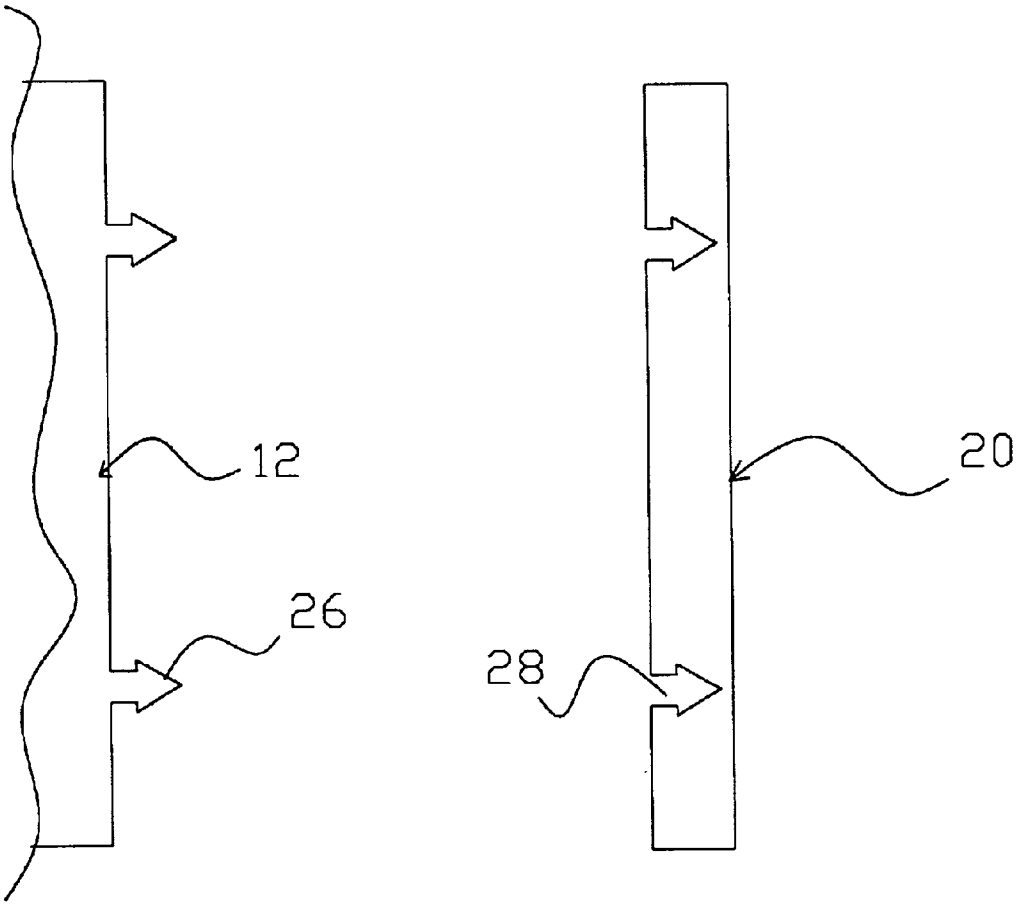
FIG. 2B are sectional views of the mounting plate and body of the toothbrush holder according to a preferred embodiment of the present invention, showing the barbed pins and their mating holes.
Figure 3A:
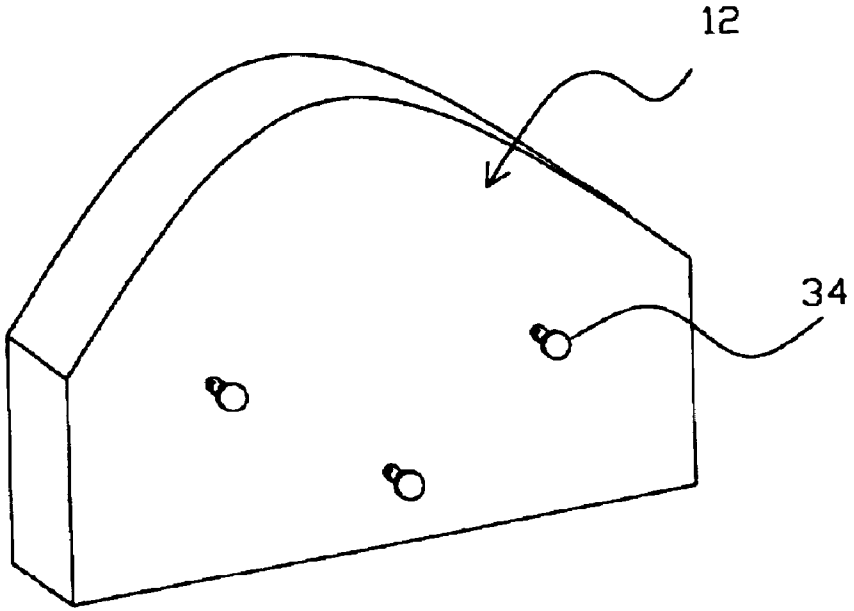
FIG. 3A is a perspective view of the back of the body of a toothbrush holder according to an alternate embodiment of the present invention; and, FIG. 3B is a front perspective view of the mounting plate of a toothbrush holder according to an alternate embodiment of the present invention, showing the pins and the keyhole shaped holes.
Figure 3B:
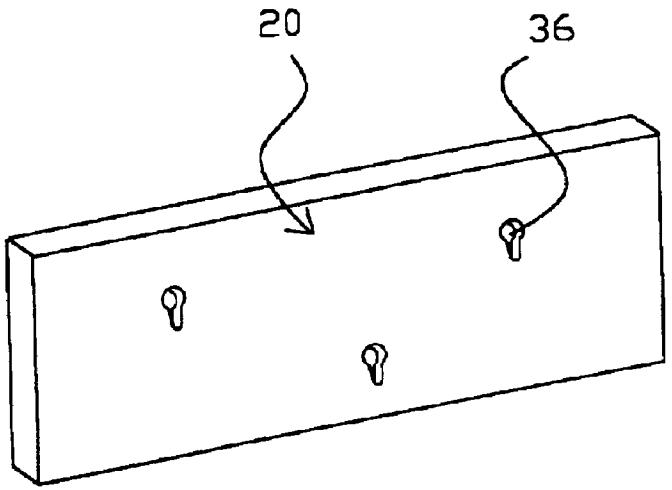

While body 12 may be affixed directly to a wall or other structural surface, as by screws passing through one or more mounting holes formed in body 12, mounting tape, or the like, body 12 preferably is carried by mounting plate 20. Accordingly, with reference to FIGS. 1–3B, mounting plate 20 is attached to wall W by means which are well known in the art, and which could include screws, nails, or double faced tape. With reference to FIGS. 2A–2B, body 12 is then removably attached to mounting plate 20, for example, by a plurality of expandable barbed pins 26 that snap into holes 28 in mounting plate 20. In an alternative arrangement, seen with reference to FIG. 1, inboard facing rails 30 integral to mounting plate 20 slidably engage outboard facing rails 32 to hold body 12 to mounting plate 20. In yet another embodiment, seen with reference to FIGS. 3A–3B, pins 34 in the back of body 12 with enlarged heads, hook into keyhole shaped slots 36 in mounting plate 20 to hold body 12 to mounting plate 20. Other means well known in the art that could include hooks, hook-and-loop fasteners, and/or other similar arrangements are also possible.

In an alternate embodiment, rubber grommets 16 for holding toothbrush T are replaced with stainless steel rods that may be coated with rubber. All other features of such an embodiment are essentially the same as the preferred embodiment.

In another alternate embodiment, it is contemplated that mounting plate 20 (or independently, body 12) could possess suction cups to permit the attachment of toothbrush holder 10 to a tiled-wall/backsplash and/or any other surface possessing a generally low coefficient of friction.

In yet another alternate embodiment, it is contemplated that cavities 14 could possess a size and shape that would facilitate the accommodation of other dental-cleaning utensils therein, such as, for exemplary purposes only, water picks, dental picks, sticks and/or other forms of interdental cleaners.

In still another alternate embodiment, cavities 14 could possess sufficiently ventilated doors that permit requisite aeration of cavities 14 and toothbrushes T.

In still another alternate embodiment, it is contemplated that body 12 could possess a floss dispensing mechanism and/or a floss package retaining mechanism.

In still another alternate embodiment, it is contemplated that toothbrush holder 10 could possess a door-hook mechanism that would enable holder 10 to be hung from the door of a medicine cabinet or from a drawer.

In still another alternate embodiment, it is contemplated that cavities 14 could be color-coded, name-tagged and/or possess other forms of indicia that would permit users of holder 10 to identify and personalize cavities 14 such that a specific toothbrush T is consistently maintained within a specific cavity 14; thus, preventing the introduction of foreign bacteria from one cavity 14 to another.

In use, the user simply snaps toothbrush T into a desired cavity 14. When the cleaning of device 10 becomes necessary, the user unfastens it from mounting plate 20 and washes it in a dishwasher, or by hand, and refastens it to mounting plate 20. Grommets 16 may also be removed for separate cleaning.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A toothbrush holder, comprising:

means for removably securing a toothbrush within a generally oval toothbrush-head receiving cavity formed within said means for removably securing a toothbrush, said cavity having generally smooth walls and an integrally-formed accessway dimensioned to slidably receive the handle of the toothbrush, said accessway adapted to support the toothbrush head within said cavity;

said means adapted to partially enclose the toothbrush when the toothbrush is introduced thereto; and, means for mounting said means for removably securing a toothbrush upon a surface.

2. The toothbrush holder of claim 1, wherein said means for removably securing a toothbrush is at least one member having at least one cavity formed therein, said at least one cavity dimensioned to receive and partially enclose the head of the toothbrush.

3. The toothbrush holder of claim 2, wherein said at least one cavity possesses at least one grommet for removably and frictionally holding a toothbrush therein.

4. The toothbrush holder of claim 2, wherein said at least one cavity is lined with a material adapted to conform to the general shape of the head of the toothbrush bearing thereagainst.

5. The toothbrush holder of claim 1, wherein said means for mounting said means for removably securing a toothbrush is at least one mounting plate having at least one female receiver removably securable to at least one male member formed on said means for removably securing a toothbrush, and wherein said means for mounting is adapted for affixation to a wall.

6. The toothbrush holder of claim 1, wherein said means for mounting said means for removably securing a toothbrush is at least one mounting plate having at least one inboard rail slidably engageable with at least one outboard rail formed on said means for removably securing a toothbrush, and wherein said means for mounting is adapted for affixation to a wall.

7. The toothbrush holder of claim 1, wherein said means for removably securing a toothbrush further comprises at least one means adapted for supporting a container of toothpaste.

8. A toothbrush holder, comprising:

a holder body for removably securing a toothbrush within a cavity formed therewithin, said holder body having a substantially smooth exterior surface and said cavity having arcuate side walls generally defining an elliptical shape;

said holder body adapted to partially enclose the toothbrush when the toothbrush is introduced thereto;

said holder body further comprising a mounting element; and, means for affixing said holder body to a surface, said means comprising a mounting element adapted to cooperatively engage said holder body mounting element.

9. The toothbrush holder of claim 8, wherein said holder body comprises at least one cavity formed therein, said at least one cavity dimensioned to receive and partially enclose the head of the toothbrush.

10. The toothbrush holder of claim 9, wherein said at least one cavity carries at least one grommet for removably and frictionally holding the toothbrush therein.

11. The toothbrush holder of claim 9, wherein said at least one cavity is lined with a material adapted to conform to the general shape of the head of the toothbrush bearing thereagainst.

12. The toothbrush holder of claim 8, wherein said means for affixing said holder body to a wall comprises at least one mounting plate having at least one female mounting element removably securable to at least one male mounting element formed on said holder body.

13. The toothbrush holder of claim 8, wherein said means for affixing said holder body to a surface comprises at least one mounting plate having at least one inboard rail mounting element slidably engageable with at least one outboard rail mounting element formed on said holder body.

14. The toothbrush holder of claim 8, wherein said holder body further comprises at least one means adapted for supporting a container of toothpaste.

15. The toothbrush holder of claim 8, wherein said means for affixing said holder body to a surface comprises at least one screw.

16. The toothbrush holder of claim 8, wherein said means for affixing said holder body to a surface is double-faced tape.

17. A toothbrush holder, comprising:

a one-piece holder body for receiving and supporting a toothbrush within a cavity formed within said holder body, said cavity comprising an essentially continuous, arcuate peripheral wall and a toothbrush-supporting drainage aperture;

said holder body adapted to partially surround the toothbrush head with said peripheral wall of said cavity and to retain the handle of the toothbrush within said toothbrush supporting drainage aperture;

said holder body further comprising a mounting element;

means for affixing said holder body to a surface, said means comprising a mounting element adapted to cooperatively engage said holder body mounting element; and, means for supporting a container of toothpaste.

18. The toothbrush holder of claim 17, wherein said cavity possesses at least one grommet for removably holding a toothbrush therein.

19. The toothbrush holder of claim 17, wherein said cavity is lined with a material adapted to conform to the general shape of the head of a toothbrush bearing thereagainst.

20. The toothbrush holder of claim 17, wherein said means for affixing said holder body to a wall comprises at least one mounting plate having at least one female mounting element removably securable to at least one male mounting element formed on said holder body.

21. The toothbrush holder of claim 17, wherein said means for affixing said holder body to a surface comprises at least one mounting plate having at least one inboard rail mounting element slidably engageable with at least one outboard rail mounting element formed on said holder body.

* * * * *